US009523956B2

(12) United States Patent
Hunter et al.

(10) Patent No.: US 9,523,956 B2
(45) Date of Patent: Dec. 20, 2016

(54) TRANSLATING PRE-TRANSFER BAFFLE FOR OPTIMIZED PERFORMANCE

(71) Applicant: Xerox Corporation, Norwalk, CT (US)

(72) Inventors: Jonathan B. Hunter, Marion, NY (US); David Mark Kerxhalli, Rochester, NY (US); David R. Kretschmann, Webster, NY (US); Ronald W. Bogert, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 192 days.

(21) Appl. No.: 13/966,826

(22) Filed: Aug. 14, 2013

(65) Prior Publication Data

US 2015/0050058 A1 Feb. 19, 2015

(51) Int. Cl.
*B65H 5/36* (2006.01)
*G03G 15/00* (2006.01)

(52) U.S. Cl.
CPC ..... *G03G 15/6558* (2013.01); *B65H 5/36* (2013.01); *G03G 15/6529* (2013.01); *B65H 2301/33214* (2013.01); *B65H 2301/3421* (2013.01); *B65H 2301/3422* (2013.01); *B65H 2404/6112* (2013.01); *G03G 2215/00675* (2013.01); *G03G 2215/00679* (2013.01)

(58) Field of Classification Search
CPC .... G03G 15/6558; B41J 13/0063; B65H 5/36; B65H 2301/33214; B65H 2301/3422
See application file for complete search history.

(56) References Cited

U.S. PATENT DOCUMENTS

| | | | | |
|---|---|---|---|---|
| 4,739,362 | A | 4/1988 | Kau et al. | |
| 8,155,572 | B2 | 4/2012 | Richards | |
| 2011/0305490 | A1* | 12/2011 | Richards et al. | 399/316 |
| 2012/0228818 | A1* | 9/2012 | Seki | 271/109 |

* cited by examiner

*Primary Examiner* — Laura Martin
*Assistant Examiner* — John M Royston
(74) *Attorney, Agent, or Firm* — Simpson & Simpson, PLLC

(57) ABSTRACT

An apparatus adapted for presenting a sheet of media to an image transfer structure. The apparatus includes a registration baffle positioned in an offset relationship relative to the image transfer structure and a pre-transfer baffle assembly including a first baffle oppositely disposed to a second baffle, the pre-transfer assembly generally forms an "S" shape and is adapted for guiding the sheet of media from the registration baffle to the image transfer structure. The pre-transfer baffle assembly is arranged in a first position adapted for guiding the sheet of media toward the image transfer structure at an angle of less than ninety degrees, and the pre-transfer baffle automatically begins rotation to a second position as the sheet of media reaches a pre-determined position within a paper path.

9 Claims, 3 Drawing Sheets

TRANSLATING PRE-TRANSFER BAFFLE FOR OPTIMIZED PERFORMANCE

INCORPORATION BY REFERENCE

The following patent is incorporated herein by reference in its entirety: U.S. Pat. No. 8,155,572, issued on Apr. 10, 2012.

TECHNICAL FIELD

The presently disclosed embodiments are directed to providing an unimpeded transfer of a toner image from a photoreceptor or other image transfer structure, e.g., transfer belt, to a media sheet. More specifically, the presently disclosed embodiments are directed to an apparatus adapted to present the lead edge of a media sheet at the optimal angle for transfer of a toner image from a photoreceptor or other image transfer structure to the media sheet, while allowing the trail edge of the media sheet to be free of drag as it passes through the baffle.

BACKGROUND

Known pre-transfer baffles comprise shapes that have been optimized over the years for performance at the lower end of the range of media weights. Over time, however, users of xerographic devices have demanded systems capable of handling heavier and larger media. More recent systems permit sheet lengths from 22.5 inches to 26 inches, and some recent systems permit sheet weights as high as 350 grams per square meter (gsm). Larger, heavier sheets exhibit more drag through the pre-transfer baffle, and as such print quality defects are generated on the sheets causing, for example, longitudinal bands across the image.

Known systems attempt to accommodate two different weight medias using a single geometry, i.e., the known pre-transfer arrangement. Lighter weight paper requires a steep angle of attack relative to the bottom of the photoreceptor belt which forces the paper into contact with the belt. If the angle of attack is too shallow, the paper flutters, and only a partial image transfer occurs. Contrarily, heavier weight paper is stiffer and when the trailing edge impacts the photoreceptor belt a perturbation is caused resulting in band formation in the image. Additionally, perturbations can be caused by impact of the lead edge on belt, in other words, as the lead edge contacts the belt during its approach.

A variety of defects can occur due to the foregoing perturbations. For example, perturbations may cause shift of the media relative to the belt thereby causing image offset relative to the media. Electrostatic issues may arise as the media impacts the belt and causes a transient in the belt. As the media passes through the baffle, the trail edge of the media may stick to the baffle thereby shifting the media relative to the belt. The foregoing defects may also result in banding of the image deposited on the media as depicted in FIG. 1. Media 10 comprises printed image 12 having bands 14 appearing therein.

U.S. Pat. No. 4,739,362 (the '362 patent) discloses an improved transfer station baffle arrangement comprising first and second baffles. The first baffle includes a curved sheet supporting surface imparting a bow to sheets passing thereby. The second baffle normally biases the sheets against the first baffle and is biasable out of position with respect to the first baffle. The '362 patent fails to address the need to alter the angle of approach of the media as the media contacts the photoreceptor belt.

U.S. Pat. No. 8,155,572 (the '572 patent) proposes a dual position media registration transport and media pre-transfer baffle geometry to enable printing on heavy weight media materials, e.g., for packaging. Known media pre-transfer geometry limits processing heavy weight media due to the inherent "S" baffle pre-transfer geometry. The packaging industry requires heavy weight media, e.g., greater than 350 gsm. The '572 patent enables a two position pre-transfer baffle assembly. The standard pre-transfer baffle assembly position allows normal weight media to enter the pre-transfer baffle assembly with the normal "S" shape, which allows all performance specifications to be maintained. Trained operators can also change several items related to the pre-transfer baffle assembly to a second position, which allows heavy weight media to properly pass. The second position provides a straightened path and enables heavy weight media and packaging materials to enter the pre-transfer area. This enables the printing of these media and materials, which could not be processed through the "S" shape of the standard pre-transfer baffle assembly position. The foregoing arrangement fails to fully accomplish the desired outcome, i.e., efficient, user independent operation of a pre-transfer baffle.

SUMMARY

Broadly, the present disclosure includes an apparatus adapted to present the lead edge of a sheet of media at an optimal angle for image transfer, and to allow the trail edge of the sheet of media to be free of drag as it passes through the baffle assembly. The foregoing is accomplished by a rotating baffle assembly that cycles through an arc for each sheet of media as it passes through to the transfer zone.

According to aspects illustrated herein, there is provided a method for presenting a sheet of media to an image transfer structure. The method includes moving the sheet of media from a registration baffle to a pre-transfer baffle assembly, wherein the pre-transfer baffle assembly includes a first baffle oppositely disposed to a second baffle, the pre-transfer assembly generally forms an "S" shape and is arranged in a first position, guiding the sheet of media toward a transfer point of the image transfer structure with the pre-transfer baffle assembly, rotating the pre-transfer baffle assembly from the first position to a second position, wherein the pre-transfer baffle assembly in the second position is in registered alignment with a media path tangential to the transfer point of the image transfer structure, guiding the sheet of media along the image transfer structure, and rotating the pre-transfer baffle assembly from the second position to the first position.

According to other aspects illustrated herein, there is provided an apparatus adapted for presenting a sheet of media to an image transfer structure. The apparatus includes a registration baffle positioned in an offset relationship relative to the image transfer structure and a pre-transfer baffle assembly including a first baffle oppositely disposed to a second baffle, the pre-transfer assembly generally forms an "S" shape and is adapted for guiding the sheet of media from the registration baffle to the image transfer structure. The pre-transfer baffle assembly is arranged in a first position adapted for guiding the sheet of media toward the image transfer structure at an angle of less than ninety degrees, and the pre-transfer baffle automatically begins rotation to a second position as the sheet of media reaches a pre-determined position within a paper path.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
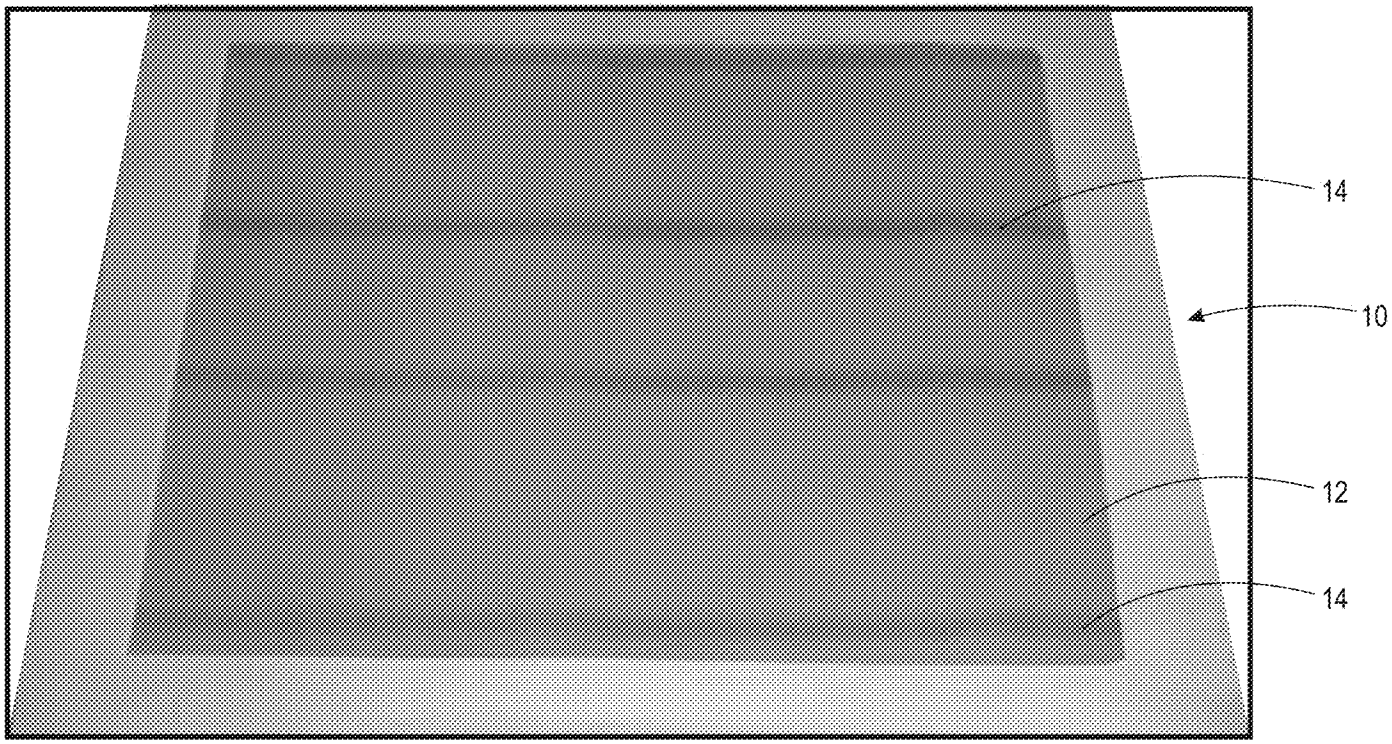
FIG. 1 is an example of a transfer process defect.

At the outset, it should be appreciated that like drawing numbers on different drawing views identify identical, or functionally similar, structural elements of the embodiments set forth herein. Furthermore, it is understood that these embodiments are not limited to the particular methodology, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong. As used herein, "pre-transfer baffle assembly" is intended to be broadly construed as any baffle system positioned prior to a transfer zone of a xerographic or other printing system. A pre-transfer baffle assembly may comprise one or more surfaces arranged to control the approach of a media sheet towards a photoreceptor or transfer belt. Furthermore, as used herein, "lead edge" is intended to mean the edge of the paper which is the first to reach various locations within a printing device as the paper moves through the device, while "trail edge" is intended to mean the edge of the paper which is the last to reach various locations within the printing device as the paper moves through the device.

Furthermore, the words "printer," "printer system", "printing system", "printer device" and "printing device" as used herein encompasses any apparatus, such as a digital copier, bookmaking machine, facsimile machine, multi-function machine, etc. which performs a print outputting function for any purpose, while "multi-function device" and "MFD" as used herein is intended to mean a device which includes a plurality of different imaging devices, including but not limited to, a printer, a copier, a fax machine and/or a scanner, and may further provide a connection to a local area network, a wide area network, an Ethernet based network or the internet, either via a wired connection or a wireless connection. An MFD can further refer to any hardware that combines several functions in one unit. For example, MFDs may include but are not limited to a standalone printer, one or more personal computers, a standalone scanner, a mobile phone, an MP3 player, audio electronics, video electronics, GPS systems, televisions, recording and/or reproducing media or any other type of consumer or non-consumer analog and/or digital electronics. Additionally, as used herein, "media," "sheet," "sheet of paper" and "paper" refer to, for example, paper, transparencies, parchment, film, fabric, plastic, photo-finishing papers or other coated or non-coated substrate media in the form of a web upon which information or markings can be visualized and/or reproduced.

As used herein, the term 'average' shall be construed broadly to include any calculation in which a result datum or decision is obtained based on a plurality of input data, which can include but is not limited to, weighted averages, yes or no decisions based on rolling inputs, etc.

Moreover, although any methods, devices or materials similar or equivalent to those described herein can be used in the practice or testing of these embodiments, some embodiments of methods, devices, and materials are now described.

Figure 2:
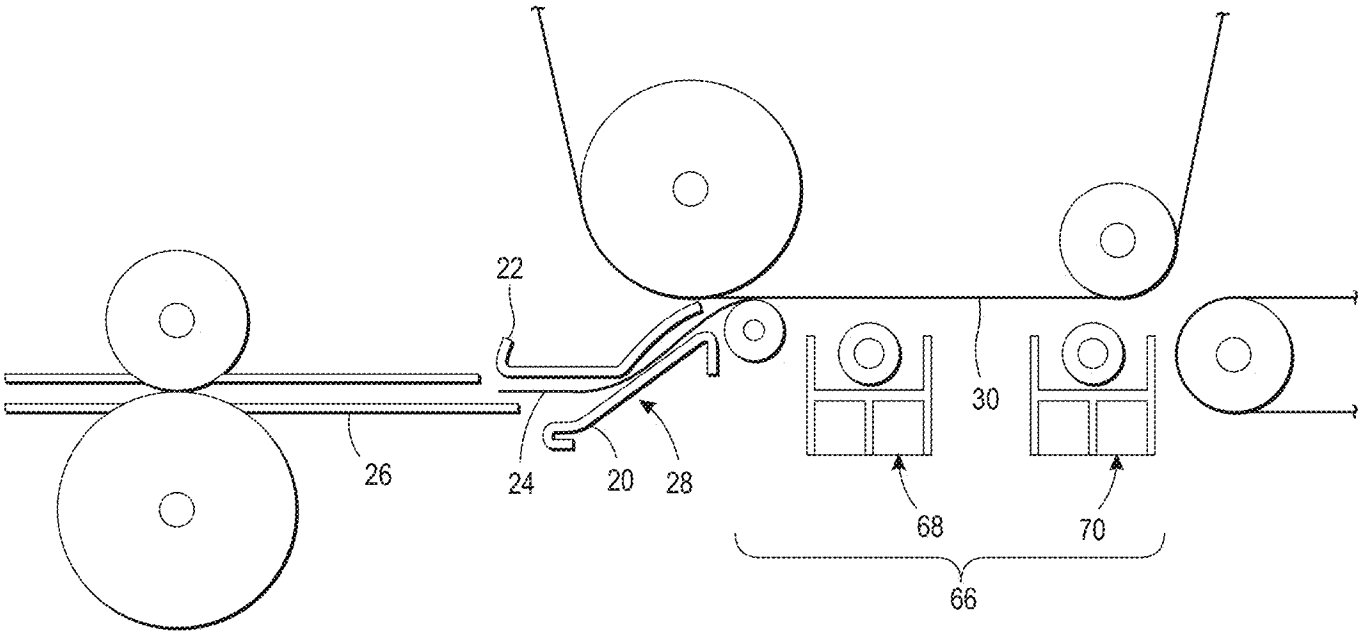
FIG. 2 PRIOR ART
FIG. 2 is a schematic diagram of a xerographic transfer zone.

FIG. 2 is a schematic diagram of a known xerographic transfer zone. Pre-transfer baffles 20 and 22 have shapes that have been optimized over the years for performance at the lower end of the range of media weights. As paper 24 exits registration baffle 26, it passes through an "S" bend as it travels through the pre-transfer baffle assembly 28, i.e., the combination of pre-transfer baffles 20 and 22. This "S" bend geometry was chosen to present the lead edge of paper 24 at the optimal angle to photoreceptor belt 30, in order to optimize the paper's tacking to the belt, thereby optimizing transfer performance. This is especially critical with lighter weight media as the beam strength of the media is decreased. It should be appreciated that registration baffle 26 is offset from photoreceptor belt 30 so that paper 24 may be guided toward belt 30 at an angle of less than ninety degrees.

New demands for printing capabilities have created the need to handle heavier and larger media. For example, maximum sheet lengths have increased from 22.5 inches to 26 inches, and sheet weight has increased to 350 gsm. These larger, heavier sheets exhibit more drag through pre-transfer baffle assembly 28. As the larger, heavier, and stiffer paper is forced through the "S" baffle, a drag force is imparted on sheet 24, up to the point where sheet 24 slips at image transfer. This slipping can cause print quality defects on the sheets as discussed supra, e.g., longitudinal bands across the image as depicted in FIG. 1.

The present device, which overcomes the deficiencies of the known devices, comprises an automatically rotating baffle, i.e., pre-transfer baffle assembly 50. As lead edge 52 of sheet 54 enters baffle assembly 50, baffle assembly 50 is in a position similar to that of known "S" baffles. As such, lead edge 52 is presented to photoreceptor belt 56 in the same attitude as currently implemented designs. As described above, this arrangement is especially beneficial for lightweight media.

Once sheet 54 is tacked to belt 56 and captured by transfer, sheet 54 continues through baffle assembly 50. As trail edge 58 of sheet 54 nears baffle assembly 50, baffle assembly 50 automatically rotates clockwise up, i.e., as depicted by bi-directional arrow 60, to the position where path 62 of paper 54 is tangential to transfer point 64 of belt 56. In doing so, trail edge 58 of sheet 54 is not forced to pass through the "S" bend of baffle assembly 50, and thereby drag forces are reduced and/or eliminated. The foregoing automatic rotation of baffle assembly 50 is especially beneficial for heavyweight media.

Figure 3A:
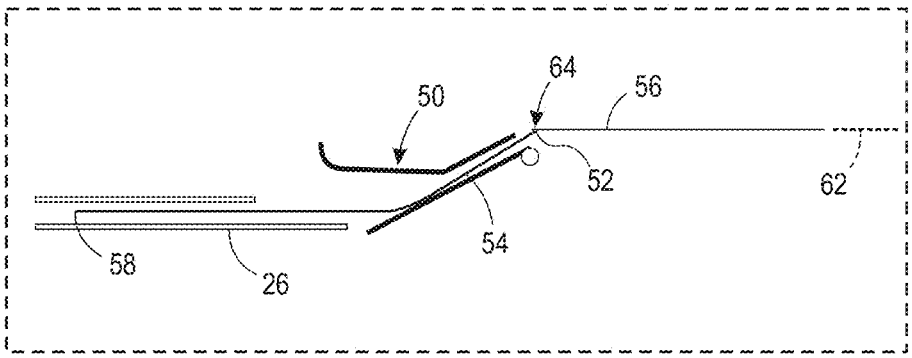
FIG. 3A is a present disclosure pre-transfer baffle in a first position.
Figure 3B:
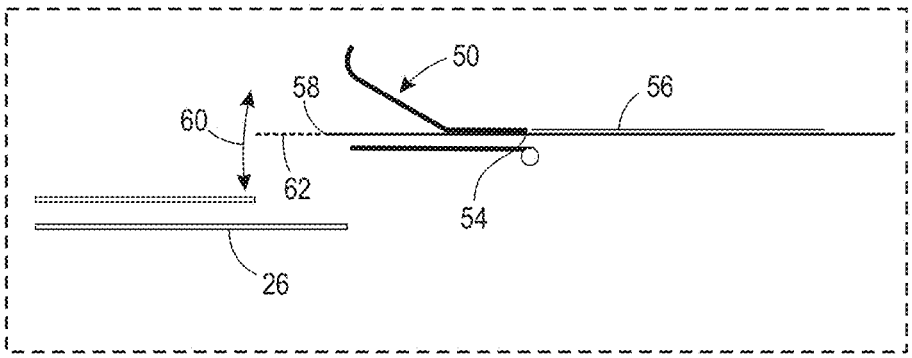
FIG. 3B is the present disclosure pre-transfer baffle of FIG. 3A in a second position.

It should be appreciated that the present device automatically shifts the position of baffle assembly 50 between a first position (See FIG. 3A) and a second position (See FIG. 3B). "Automatically rotates", as used herein, is intended to mean rotational movement of a component which occurs without interaction by a user, e.g., rotational movement initiates based on the location of sheet 54 within the paper path. The rate of rotation of baffle assembly 50 may be altered and/or optimized based on the weight and size of the media in use. Furthermore, the rate of rotation and/or acceleration/deceleration of baffle assembly 50 may also vary throughout the path of its movement. Such variation provides means to further optimize the performance of the printing system, thereby further minimizing printing defects.

It should be appreciated that deceleration may be controlled so that paper 54 does not flip up and off of baffle assembly 50. Moreover, baffle assembly 50 should not be permitted to brake rapidly immediately upon completion of rotation as such arrested movement would send a shock wave through the system.

Upon paper 54 exiting pre-transfer baffle assembly 50, baffle assembly 50 rotates back down to its initial position (See FIG. 3A) to receive the next sheet. This rotation is completed in each inter-document gap, i.e., the space between each consecutive printed image.

In some embodiments, baffle assembly 50 begins rotating at a time near the time that paper 54 contacts belt 56, e.g., as paper 54 contacts belt 56, slightly before paper 54 contacts belt 56, or slightly after paper 54 contacts belt 56. For example, movement of baffle assembly 50 may begin when a portion of paper 54 is in transfer zone 66. It has been found that shorter length paper 54 would require movement of baffle assembly 50 to begin earlier in time, while longer length paper 54 would require movement of baffle assembly 50 to begin later in time. Depending on the length of paper 54, movement of baffle assembly 50 may not begin until after lead edge 52 passes through transfer zone 66, i.e., passes past first dicor 68 or passes past second dicor 70. In short, baffle assembly 50 automatically begins rotating when paper 54 reaches a pre-determined location, i.e., a location optimized for the size and/or weight of paper 54. The present apparatus may utilize existing paper handling timing signals which provide an understanding of where the paper is located within the paper path for timing the movement of baffle assembly 50. It should be appreciated that the absolute rate of rotation at any particular time can be controlled, e.g., using a servo motor. Baffle assembly 50 may be formed from a variety of materials known in the art, e.g., stainless steel, with lower friction materials being preferred.

The present device is arranged to rotate the pre-transfer baffle assembly for every sheet that feeds through the printing system. Due to the rotation of the baffle assembly through its arc for every sheet, the present system is effectively automatically optimized for both lightweight and heavyweight media, a feature that has heretofore be unmet by known systems. The foregoing rotating pre-transfer baffle assembly geometry presents both the lead edge and trail edge of each sheet in an optimal fashion, i.e., angle, to the photoreceptor belt. The present apparatus allows the trail edge of the sheet to be free of drag as it passes through the baffle assembly. Thus, the system is optimized for both heavy and light weight media sheets, transfer related image quality defects are reduced or eliminated and much of the system's current geometry can be utilized thereby preserving system timing.

It should be appreciated that although the foregoing embodiments are described relative to xerographic printing processes, the present apparatus may be used with non-electrostatic systems, including where an image is formed on a transfer belt and subsequently transferred to paper, where an image is formed with an ink or wax, etc. Such printing systems are subject to the same issues, e.g., paper angle as it approaches a transfer belt and paper impacting the transfer belt.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A method for presenting a sheet of media to an image transfer structure, said method comprising:

a) moving the sheet of media from a registration baffle to a pre-transfer baffle assembly, wherein the pre-transfer baffle assembly comprises a first baffle oppositely disposed to a second baffle, the pre-transfer assembly generally forms an "S" shape and is arranged in a first position;

b) guiding the sheet of media toward a transfer point of the image transfer structure with the pre-transfer baffle assembly;

c) rotating the pre-transfer baffle assembly from the first position to a second position when at least a portion of the sheet of media is within the pre-transfer baffle assembly, wherein the pre-transfer baffle assembly in the second position is in registered alignment with a media path tangential to the transfer point of the image transfer structure;

d) guiding the sheet of media along the image transfer structure; and e) rotating the pre-transfer baffle assembly from the second position to the first position.

2. The method of claim 1 wherein the image transfer structure is a photoreceptor belt or a transfer belt.

3. The method of claim 1 wherein the sheet of media comprises a lead edge and the step of rotating the pre-transfer baffle assembly from the first position to the second position begins after the lead edge passes the transfer point, begins as the lead edge reaches the transfer point or begins before the lead edge reaches the transfer point.

4. The method of claim 1 wherein the sheet of media comprises a trail edge and the step of rotating the pre-transfer baffle assembly from the first position to the second position begins as the trail edge nears the pre-transfer baffle assembly.

5. The method of claim 1 wherein the pre-transfer baffle assembly located in the first position guides the sheet of media toward the image transfer structure at an angle less than ninety degrees.

6. The method of claim 1 wherein the pre-transfer baffle assembly located in the second position guides the sheet of media at an angle equal to about zero degrees relative to the image transfer structure.

7. The method of claim 1 wherein a rate of rotation of the pre-transfer baffle assembly is related to a weight and/or a size of the sheet of media.

8. The method of claim 1 wherein the step of rotating the pre-transfer baffle assembly from the second position to the first position begins after the sheet of media passes through the pre-transfer baffle assembly.

9. The method of claim 1 wherein the step of rotating the pre-transfer baffle assembly from the first position to the second position begins automatically as the sheet of media reaches a pre-determined position within a paper path.

* * * * *